US010278466B2

(12) United States Patent
Talarico

(10) Patent No.: US 10,278,466 B2
(45) Date of Patent: May 7, 2019

(54) ARTICLE ORGANIZATION AND STORAGE DEVICE

(71) Applicant: David Joseph Talarico, Holmdel, NJ (US)

(72) Inventor: David Joseph Talarico, Holmdel, NJ (US)

(73) Assignee: David Talarico, Holmdel, NJ (US)

( * ) Notice: Subject to any disclaimer, the term of this patent is extended or adjusted under 35 U.S.C. 154(b) by 28 days.

(21) Appl. No.: 15/821,752

(22) Filed: Nov. 22, 2017

(65) Prior Publication Data

US 2018/0140066 A1 May 24, 2018

Related U.S. Application Data

(60) Provisional application No. 62/425,077, filed on Nov. 22, 2016.

(51) Int. Cl.
*B65D 71/00* (2006.01)
*A45C 11/18* (2006.01)

(52) U.S. Cl.
CPC ..... *A45C 11/182* (2013.01)

(58) Field of Classification Search
CPC ..... A45C 11/182; A45C 1/06
USPC ..... 206/39.4, 39.6, 308.1, 310
See application file for complete search history.

(56) References Cited

U.S. PATENT DOCUMENTS 8,662,293 B2 * 3/2014 Lazott ..... A45C 11/182 206/39.4
8,899,411 B2 12/2014 Van Geer
9,259,065 B2 * 2/2016 Wingerter ..... A45C 1/02
9,339,094 B2 5/2016 Tucker-Skow et al.
9,545,141 B2 * 1/2017 Hsieh ..... A45C 13/185
9,681,721 B2 * 6/2017 Moon ..... A45C 11/182
2012/0067473 A1 * 3/2012 Khounsombath ..... A45C 1/06 150/147
2013/0220879 A1 * 8/2013 Glass ..... B65D 27/00 206/767
2014/0060712 A1 * 3/2014 Beckley ..... A45C 1/06 150/133
2015/0059937 A1 * 3/2015 Singer ..... A45C 1/06 150/147
2015/0208778 A1 * 7/2015 Velentzas ..... A45C 11/182 150/149
2015/0336727 A1 * 11/2015 Shin ..... B65D 85/38 206/459.5

(Continued)

FOREIGN PATENT DOCUMENTS

EP 0287532 A3 7/1989

OTHER PUBLICATIONS (Author, Title, URL, Date of Publication, Date of Retrieval) Adam Wilson, Mobius Wallet, www.kickstarter.com/projects/adamwilson/mobius-its-not-your-fathers-wallet, Jul. 15, 2013, Nov. 20, 2017.

(Continued)

*Primary Examiner* — Fenn C Mathew
*Assistant Examiner* — Cynthia F Collado

(57) ABSTRACT

A device (e.g. a wallet) for storing article(s) (e.g. credit card(s)) which is made from hard, durable materials and allows the user to easily locate and select a given article without removing all articles. The magnet-free device is safe for use with articles containing magnetically stored information (e.g. credit cards with a magnetic strip).

6 Claims, 17 Drawing Sheets

(56) References Cited

U.S. PATENT DOCUMENTS

| | | | | |
|---|---|---|---|---|
| 2016/0022000 | A1* | 1/2016 | Tucker-Skow ..... | A45C 11/182<br>150/147 |
| 2018/0140061 | A1* | 5/2018 | Chan ..... | A45C 11/182 |
| 2018/0368547 | A1* | 12/2018 | Grannan ..... | A45C 11/182 |

OTHER PUBLICATIONS (Author, Title, URL, Date of Publication, Date of Retrieval) ERASNEP LLC, Keplero, https://www.kickstarter.com/projects/381277743/keplero-luxury-wallet, Jun. 30, 2015, Nov. 20, 2017.

* cited by examiner

ARTICLE ORGANIZATION AND STORAGE DEVICE

CROSS-REFERENCE TO RELATED APPLICATIONS

This application claims the benefit of provisional patent application Ser. No. 62/425,077, filed 2016 Nov. 22 by the present inventor.

BACKGROUND

Prior Art

The following is a tabulation of some prior art that presently appears relevant:

| U.S. patents | | | |
|---|---|---|---|
| Pat. No. | Kind Code | Issue Date | Patentee |
| 8,899,411 | B2 | 2014 Dec. 2 | R. J van Geer bv, Rijswijk (NL) |
| 9,339,094 | B2 | 2016 May 17 | Spectre Wallets |

| Foreign Patent Documents | | | | |
|---|---|---|---|---|
| Foreign Doc. Nr. | Cntry Code | Kind Code | Publ. Date | Applicant |
| 0287532 | EP | A3 | 1989 Jul. 12 | Fab Trading S.R.L. |

| Web Pages | | | | |
|---|---|---|---|---|
| Author | Title | URL | Date of Publication | Date of Retrieval |
| Adam Wilson | Mobius Wallet | www.kickstarter.com/projects/adamwilson/mobius-its-not-your-fathers-wallet | 2013 Jul. 15 | 2017 Nov. 20 |
| Erasnep LLC | Keplero | https://www.kickstarter.com/projects/381277743/keplero-luxury-wallet | 2015 Jun. 30 | 2017 Nov. 20 |

Article storage devices made of soft materials (e.g. leather or fabric wallets) are prone to wear and deterioration due to the nature of soft materials. The outer surface begins to crack, interior pockets form holes and stretch out, and before long the device needs to be replaced. Some article storage devices attempt to solve this problem by storing articles between two metal plates bound by one or more wear-prone elastic bands, but this often means all of the articles need to be removed and sorted through in order to find the desired one. Some of these also damage the surface of the article which is kept adjacent to the hard material from the repeated abrasive sliding action.

One article storage device which attempts to solve these issues is the Keplero Card Holder. This device allows the user to remove a single article at a time, while keeping the other articles in order. However, the use of magnets in this device destroys the magnetically stored information on certain articles (e.g. credit cards). Therefore, its use is limited to cards which utilize RFID chips. In addition, due to the nature of the magnetic mechanism, the Keplero card holder becomes disassembled and scattered across the floor when dropped, and requires a large angle between articles when opened. These issues create an awkward user experience.

The disclosed invention is made of durable, hard materials and will allow a user to access any of their articles without removing all articles. Also, the secure mechanical fasteners used will not separate when dropped as magnets do. Furthermore, since there are no magnets, the disclosed invention is safe for use with articles containing magnetically stored information (e.g. credit cards with a magnetic strip).

DETAILED DESCRIPTION

It should be understood that aspects of the invention are described herein with reference to the figures, which show illustrative embodiments. The illustrative embodiments described herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Figure 1:
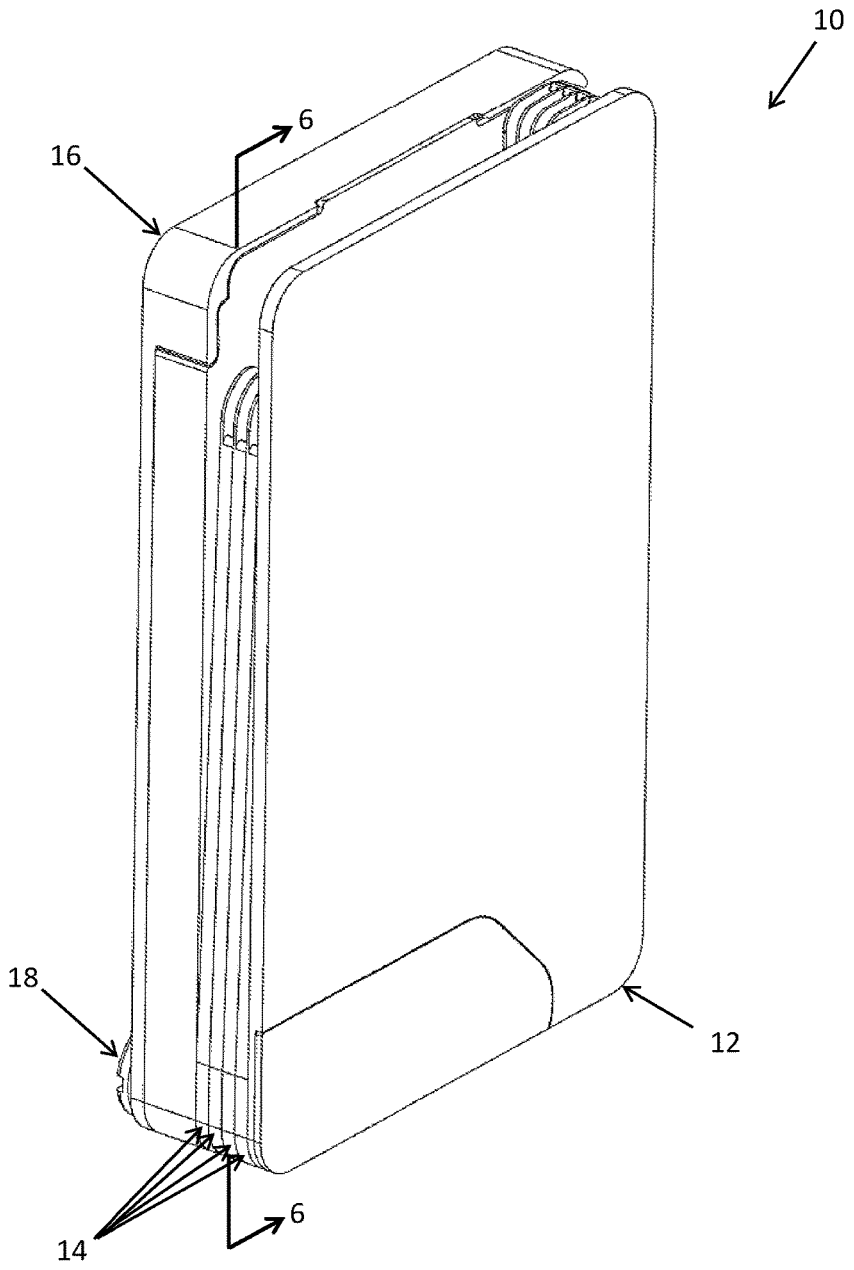
FIG. 1 is a perspective view of an article storage device in its closed configuration.
Figure 2:
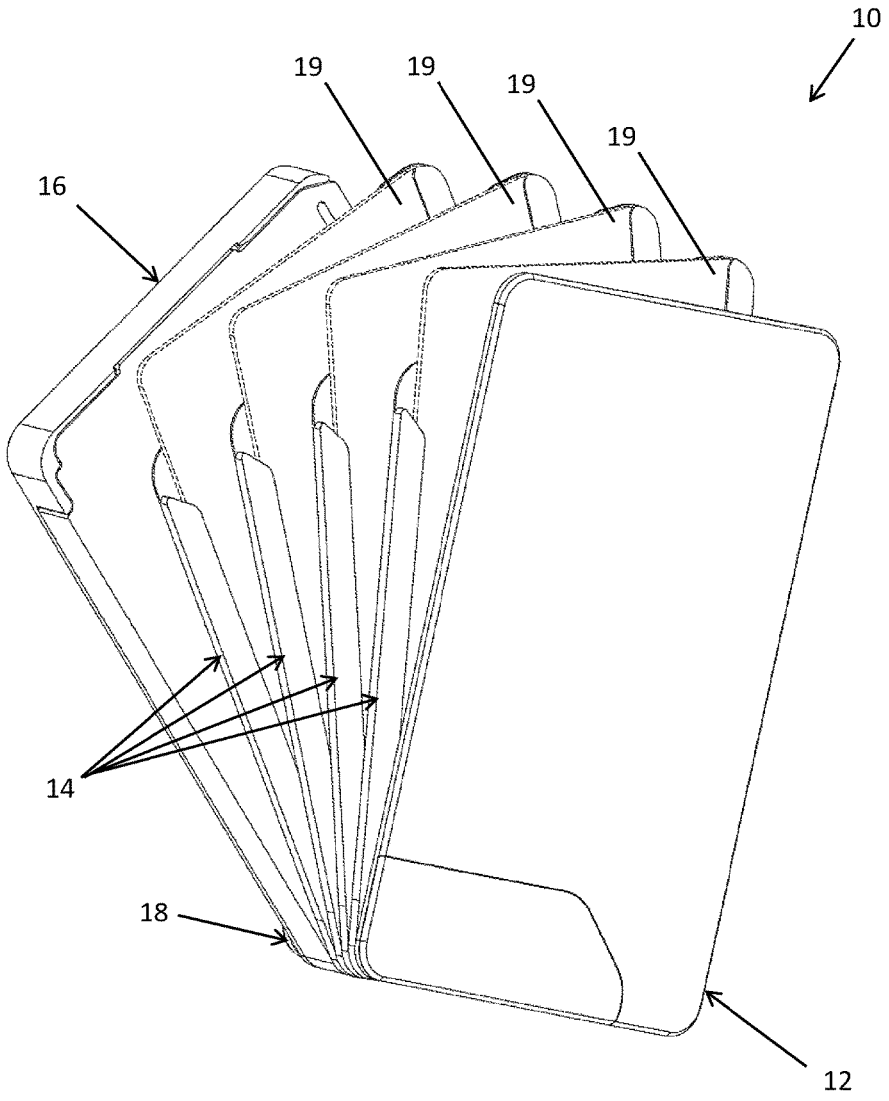
FIG. 2 is a perspective view of an article storage device containing articles with collapsible article holders in their open positions.

FIGS. 1 and 2—First Embodiment

One embodiment of an article storage device, generally designated 10, is illustrated in FIG. 1 and FIG. 2. Storage device 10 includes a front cover 12, one or more collapsible article holders 14, a rear cover 16, and a connection 18. In one embodiment, holders 14 and rear cover 16 are rotatably mounted to front cover 12 by connection 18. FIG. 2 illustrates device 10 with holders 14 in their open positions. As shown in FIGS. 1 and 2, front cover 12, holders 14, and rear cover 16 are able to toggle rotatably from their closed positions (FIG. 1) into their open positions (FIG. 2) which allow the user to view each article 19 contained within holders 14 in order to facilitate selection and removal of one or more articles 19. In one embodiment, gaps between articles are suitably large to accommodate articles with embossed features.

Figure 3:
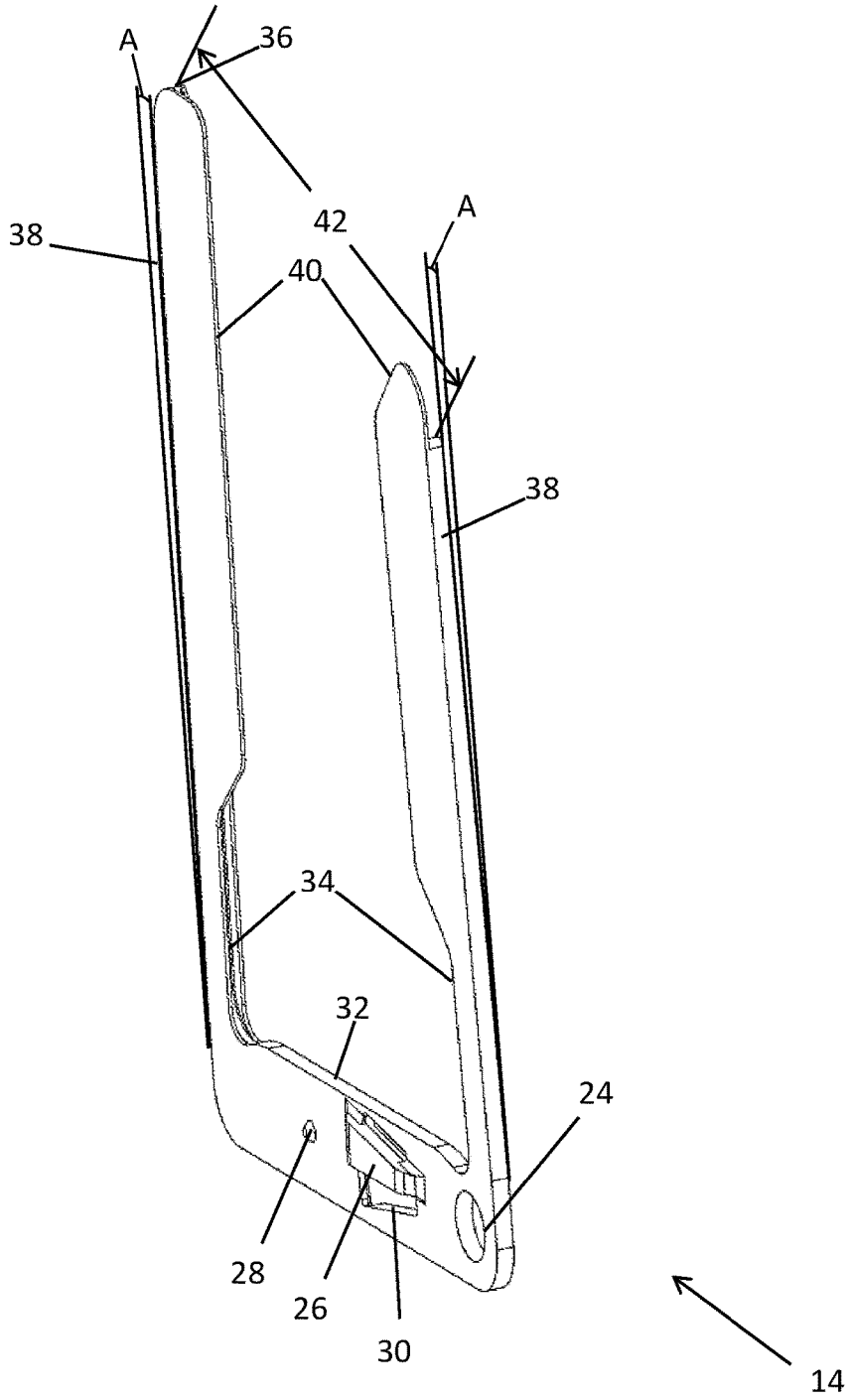
FIG. 3 is a perspective view of a collapsible article holder.

FIG. 3—an Article Holder

In one embodiment, holder 14 includes a hole 24, a holder stop 26, an indexing bump 28, indexing pockets 29 (FIG. 8), a cutout 30, an article stop 32, article grooves 34, an article hook 36, article gripping arms 38, article guide plates 40, and an insertion gap 42. In one embodiment, holder 14 is made of a high strength durable composite, such as carbon fiber. However, holder 14 can consist of any suitably durable material such as polycarbonate, ABS, Delrin, aluminum, stainless steel, carbon steel, titanium, and the like.

Hole 24 permits holder 14 to be rotatably mounted to front cover 12. Holder stop 26 may be placed into the cutout of an adjacent holder during the assembly of storage device 10. Similarly, the holder stop of a second adjacent holder may be placed into cutout 30. Holder stop 26 and cutout 30 thusly restrict the rotational position of holder 14 relative to adjacent holders to a suitable range. Similar to the interaction between holder stop 26 and cutout 30 with adjacent holders, indexing bump 28 mates with the indexing pockets of an adjacent holder and indexing pockets 29 (FIG. 8) mate with an indexing bump of a second adjacent holder. Indexing pockets 29 (FIG. 8) and indexing bump 28 thusly index holder 14 into either the open or closed position. See FIG. 5 for an exploded view of storage device 10 for further illustration of the interaction of holder 14 with adjacent holders.

Article guide plates 40 align article 19 (FIG. 2) with article grooves 34 during insertion. Article gripping arms 38 are designed so that in their relaxed state (FIG. 3) they extend upward at a slight inward angle A such that they grip an inserted article 19 with a suitable amount of force. In one embodiment, hook 36 comes slightly over the top of inserted article 19 to further prevent the unwanted removal of article 19. Insertion gap 42 must be wide enough to allow article 19 to enter article grooves 34. In one embodiment, this is accomplished by making one of the arms 38 shorter than the other. In another embodiment, insertion gap 42 is created using a lead-in chamfer (not shown). Article stop 32 stops article 19 once it is in its fully inserted position.

Figure 4:
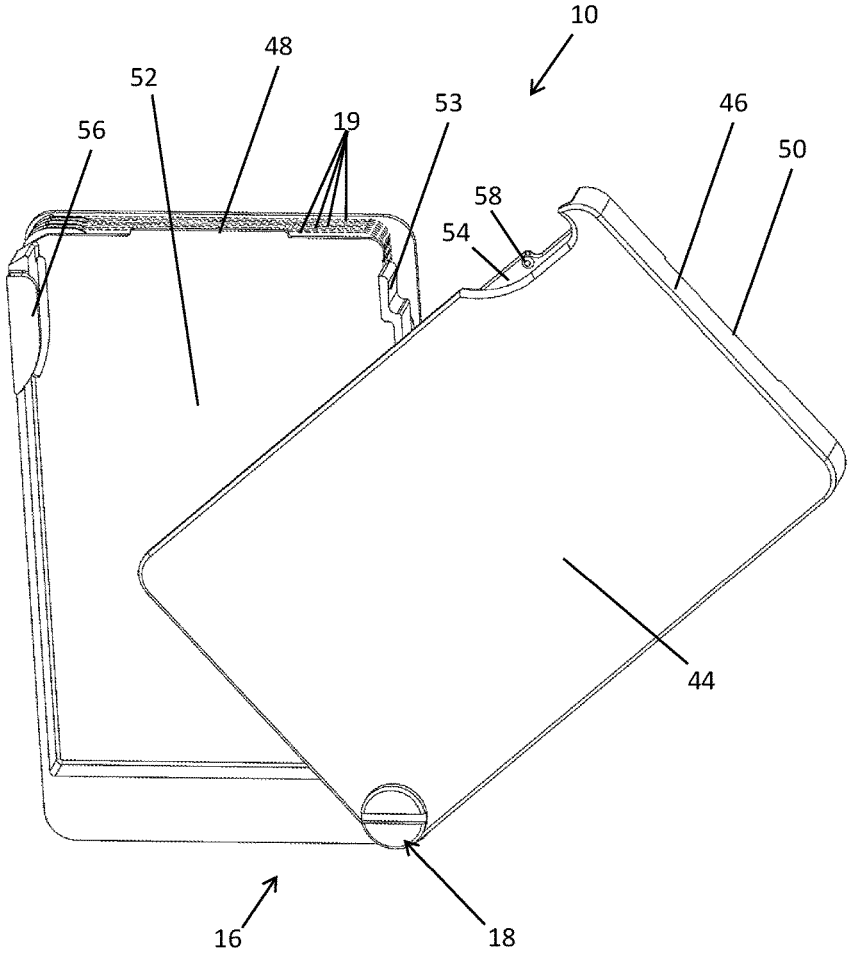
FIG. 4 is a perspective view of an article storage device with a rear cover that can store articles in its open position.

FIG. 4—A Rear Cover

Figure 8:
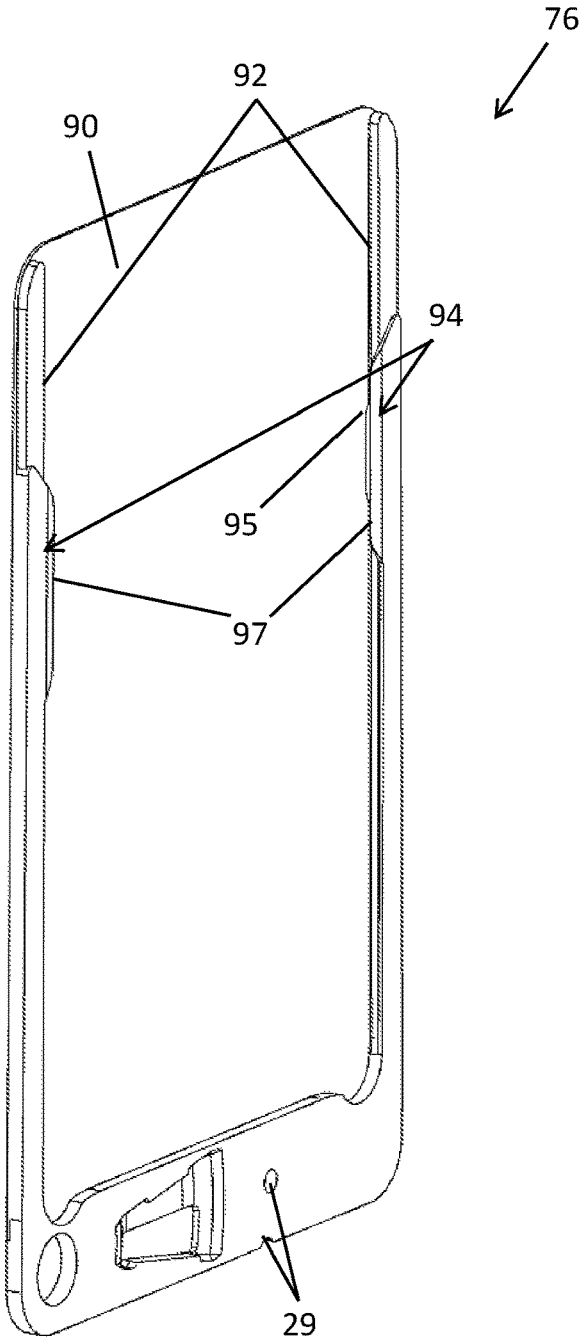
FIG. 8 is a perspective view of a collapsible article holder.

In one embodiment, rear cover 16 is able to store articles and includes a door 44, a door stop 45 (FIG. 5), a top cover 46, a door hole 47 (FIG. 5), a tongue 48, a groove 50, a container 52, a container stop 53, a lip 54, a container hole 55 (FIG. 5), an overhang 56, a door indexing bump 58, a door indexing hole (not shown), a cutout 62 (FIG. 5), and indexing pockets 29 (FIG. 8). In one embodiment, rear cover 16 is made of a high strength durable composite, such as carbon fiber. However, rear cover 16 can consist of any suitably durable material such as polycarbonate, ABS, Delrin, aluminum, stainless steel, carbon steel, titanium, and the like.

In one embodiment, door 44 and container 52 are rotatably mounted to front cover 12 through door hole 47 (FIG. 5) and container hole 55 (FIG. 5) by connection 18. Door stop 45 (FIG. 5) comes in contact with container stop 53 to suitably align door 44 with container 52 when door 44 is in its closed position. Top cover 46 prevents articles (not shown) from falling out of the top of container 52 when door 44 is in its closed position. Tongue 48 mates with groove 50 when door 44 is in its closed position so that the top of the back wall of container 52 does not collapse into the empty space of container 52 when an inward force is applied. In one embodiment, container 52 includes a geometry which is capable of holding credit cards, ID cards, paper money, coins, and the like.

Lip 54 slides under overhang 56 when door 44 is in its closed position to prevent door 44 from separating off of the front surface of container 52 when an outward force is applied (i.e. when container 52 contains a large amount of paper money). Door indexing bump 58 indexes into the door indexing hole (not shown) in overhang 56 when door 44 is in its closed position in order to prevent any unwanted rotational separation of door 44 and container 52. As can been seen from FIG. 5, cutout 62 restricts the rotational motion of adjacent holder 14, and indexing pockets 29 (FIG. 8) index holder 14 into either the open or closed position.

In one embodiment (not shown), rear cover 16 includes a money clip (not shown) which is affixed to its rear surface.

Figure 5:
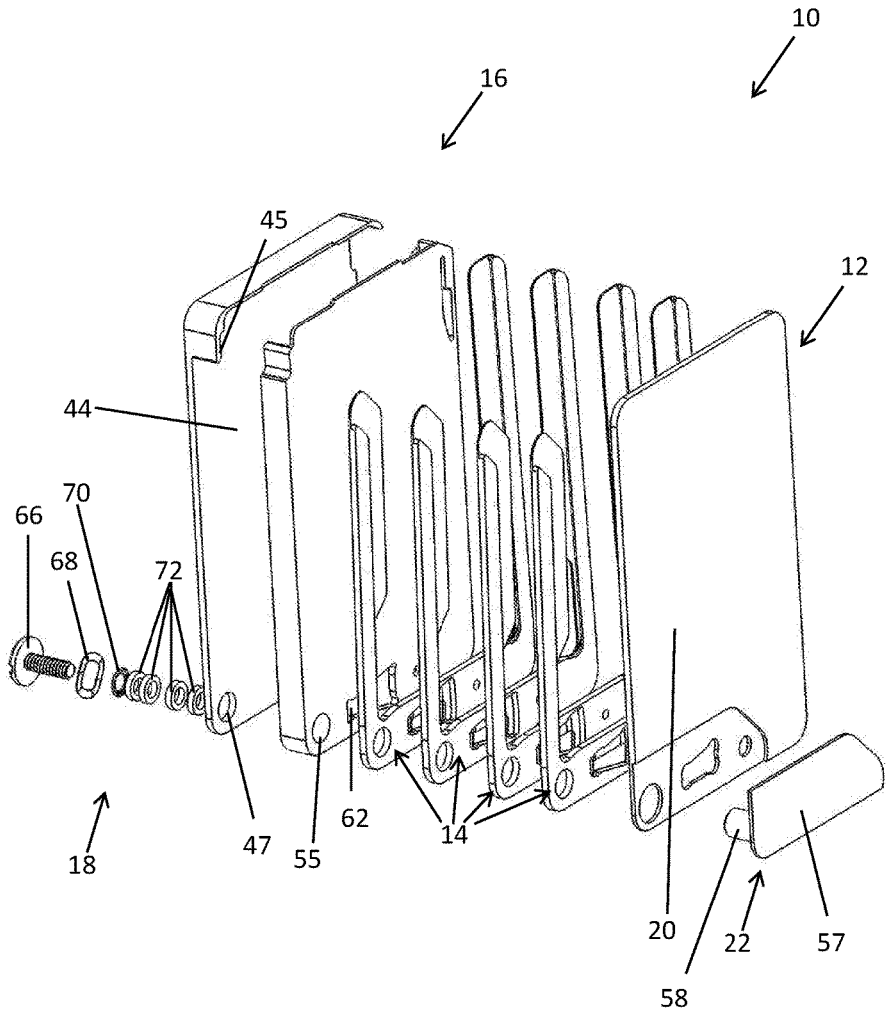
FIG. 5 is an exploded view of an article storage device.
Figure 6:
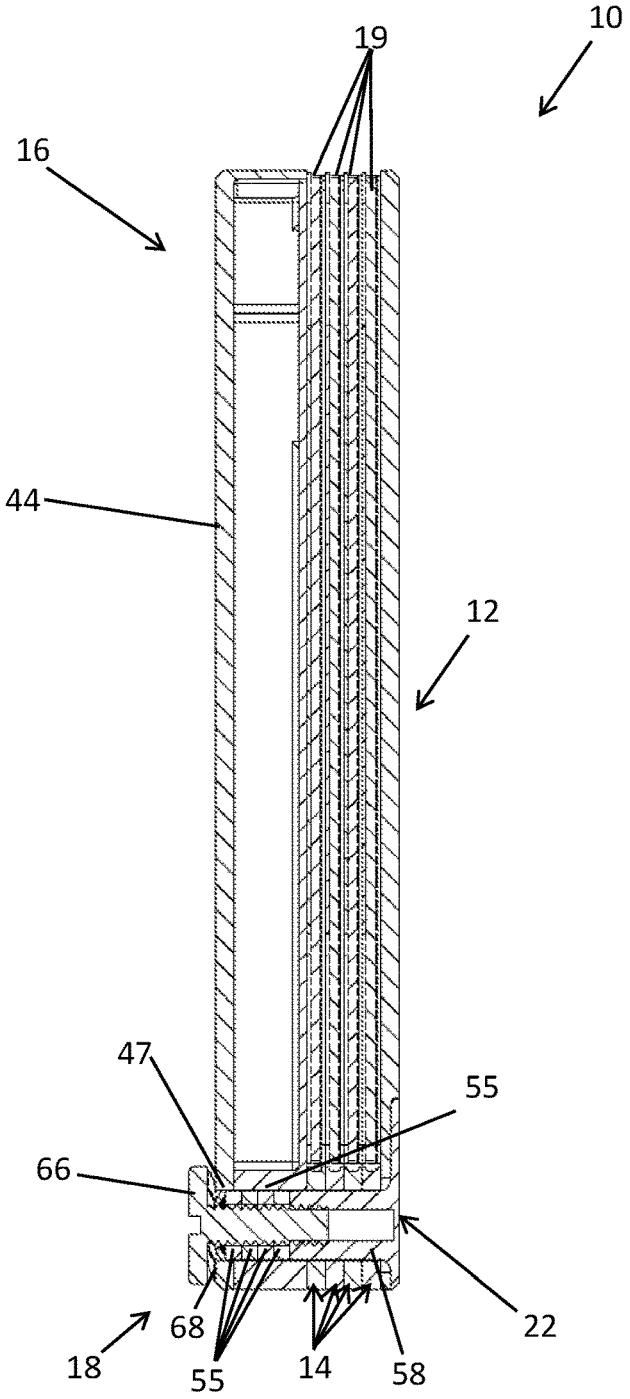
FIG. 6 is a cut away view of an article storage device containing articles in its closed configuration.

FIGS. 5 and 6—Exploded and Cross Section View of an Article Storage Device In one embodiment, front cover 12 includes a plate 20 which is bonded to an indexing attachment piece 22. In other embodiments front cover 12 is a one piece design. In one embodiment, plate 20 is made of a high strength durable composite, such as carbon fiber. However, plate 20 can consist of any suitably durable material such as polycarbonate, ABS, Delrin, aluminum, stainless steel, carbon steel, titanium, and the like.

In one embodiment, piece 22 includes a base 57 which supports a cylinder 58, a holder stop (not shown), and an indexing bump (not shown) that pass through corresponding holes in plate 20. Cylinder 58 provides an axle about which holders 14 and/or rear cover 16 are permitted to rotate. The holder stop (not shown) includes a similar geometry as holder stop 26 of holders 14 which allows it to restrict the motion of adjacent holder 14 to a suitable amount. The indexing bump (not shown) includes a similar geometry as indexing bump 28 which allows it to index adjacent holder 14 into either its open or closed position.

In one embodiment, connection 18 includes a fastener 66, a spring 68, a locking element 70, and one or more spacers 72. In one embodiment, fastener 66 is a screw and cylinder 58 has an internally threaded hole. In other embodiments, cylinder 58 has external threads and fastener 66 is an internally threaded shoulder screw about which holders 14 and/or rear cover 16 are permitted to rotate. In still other embodiments, the functions of connection 18 provided by the axle-like cylinder 58 and binding fastener 66 may comprise a grooved shaft and retaining clip (not shown), a binding post (not shown), or any other suitable means to secure a rotational assembly.

In one embodiment, storage device 10 is configurable such that the user can choose to assemble it with any number of holders 14. The user would simply install the chosen number of holders 14 along with a corresponding number of spacers 72 such that cylinder 58 is effectively extended a suitable amount to accommodate the chosen number of holders 14.

Locking element 70 is compressed between fastener 66 and either one of the spacers 72 or cylinder 58 during assembly of storage device 10, has a maximum outer diameter which is smaller than door hole 47 and container hole 55, and prevents the accidental loosening of fastener 66 during normal operation. In one embodiment, locking element 70 is a conical disc spring. In other embodiments, locking element 70 is a split washer, a temporary or permanent thread locking compound, a toothed lock washer, a wedge lock washer, and the like.

Spring 68 is compressed between fastener 66 and door 44 during assembly of storage device 10, thusly has a minimum inner diameter which is larger than door hole 47 and container hole 55, and allows for a predictable amount of force to be applied to the assembly regardless of small manufacturing errors. In one embodiment, spring 68 is a wave disc spring. In other embodiments, spring 68 is a conical spring, a helical spring, a solid polyurethane spring, a set of opposing magnets, and the like.

Figure 7:
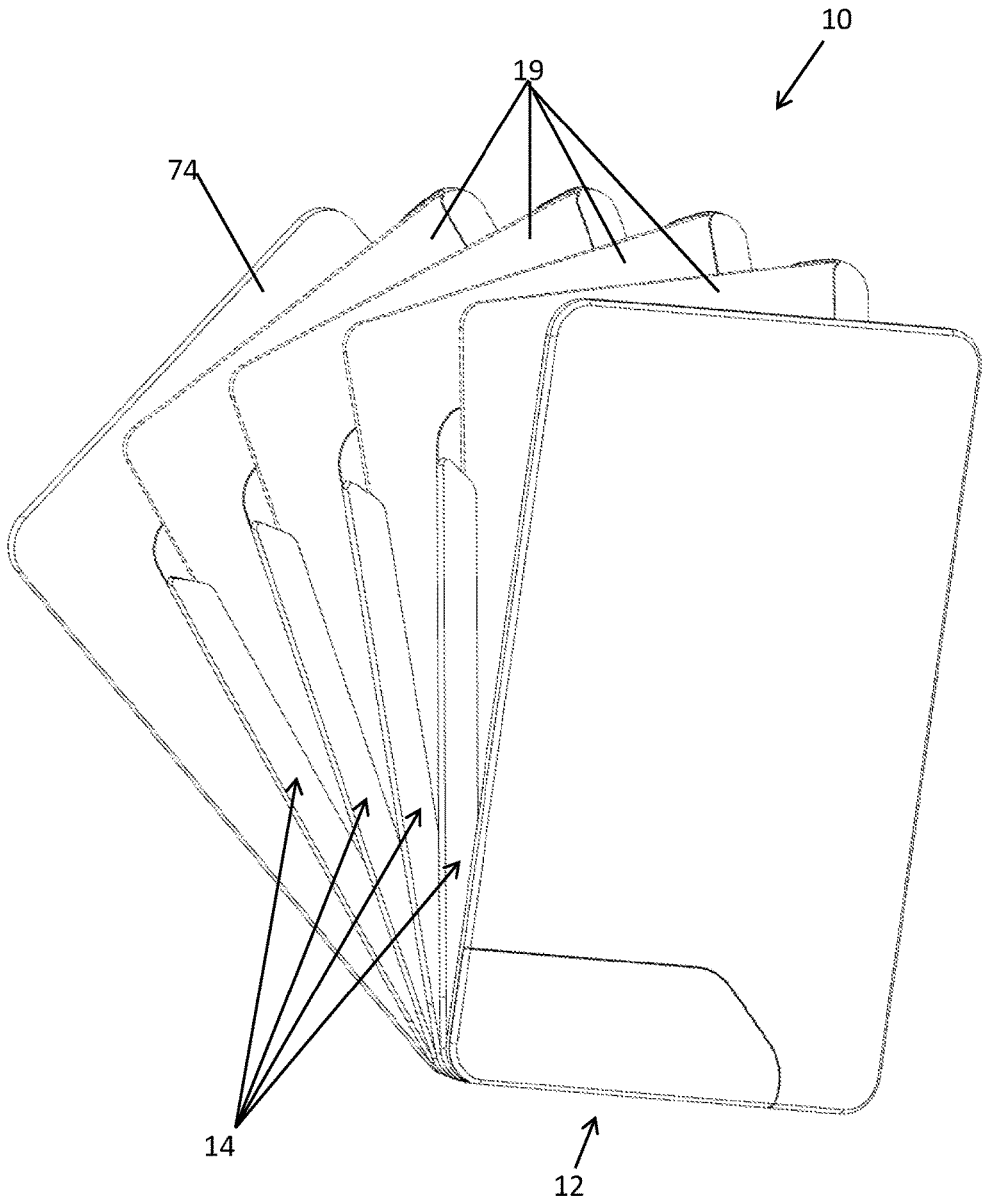
FIG. 7 is a perspective view of an article storage device containing articles with collapsible article holders in their open positions.

FIG. 7—Another Embodiment

In one embodiment of storage device 10, rear cover 16 is replaced with rear cover 74, which is not able to store articles and includes a hole (not shown), a cutout (not shown), and indexing pockets (not shown) which are functionally equivalent to door hole 47 (FIG. 5), cutout 62 (FIG. 5), and indexing pockets 29 (FIG. 8), respectively. In one embodiment, rear cover 74 is made of a high strength durable composite, such as carbon fiber. However, rear cover 74 can consist of any suitably durable material such as polycarbonate, ABS, Delrin, aluminum, stainless steel, carbon steel, titanium, and the like. In one embodiment (not shown), rear cover 74 includes a money clip (not shown) which is affixed to its rear surface.

Figure 9:
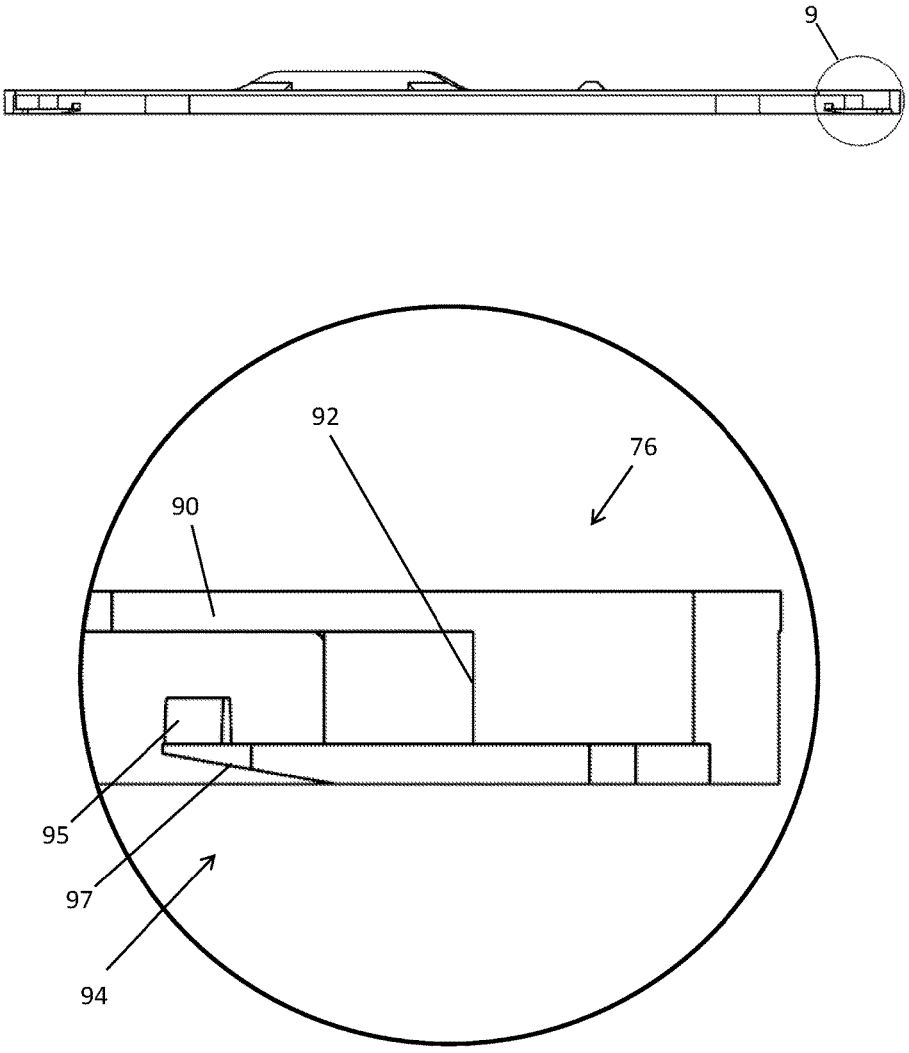
FIG. 9 is a detail view of an article gripper.

FIGS. 8 and 9—Another Article Holder Embodiment

In one embodiment, an article holder 76 includes all of the elements of holder 14 except for article grooves 34, article hook 36, article gripping arms 38, article guide plates 40, and insertion gap 42. Holder 76 further includes a back wall 90, side walls 92 and article grippers 94. In one embodiment, holder 76 is made of a high strength durable composite, such as carbon fiber. However, holder 76 can consist of any suitably durable material such as polycarbonate, ABS, Delrin, aluminum, stainless steel, carbon steel, titanium, and the like.

Back wall 90 and side walls 92 aid the alignment and insertion of an article (not shown) into holder 76. Grippers 94 contact the surface of an inserted article to prevent unwanted motion of the article. Grippers 94 include a rounded lead-in 95 to aid insertion as well as a tapered edge 97 so that once the article is inserted, the deflected grippers 94 do not interfere with an adjacent holder.

Figure 10:
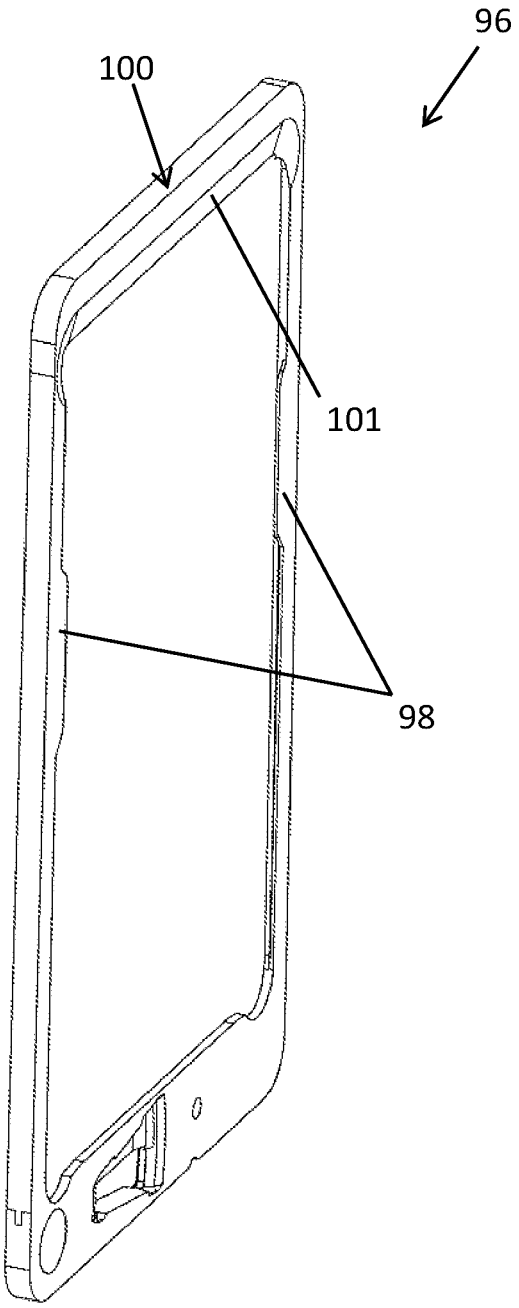
FIG. 10 is a perspective view of a collapsible article holder.
Figure 11:
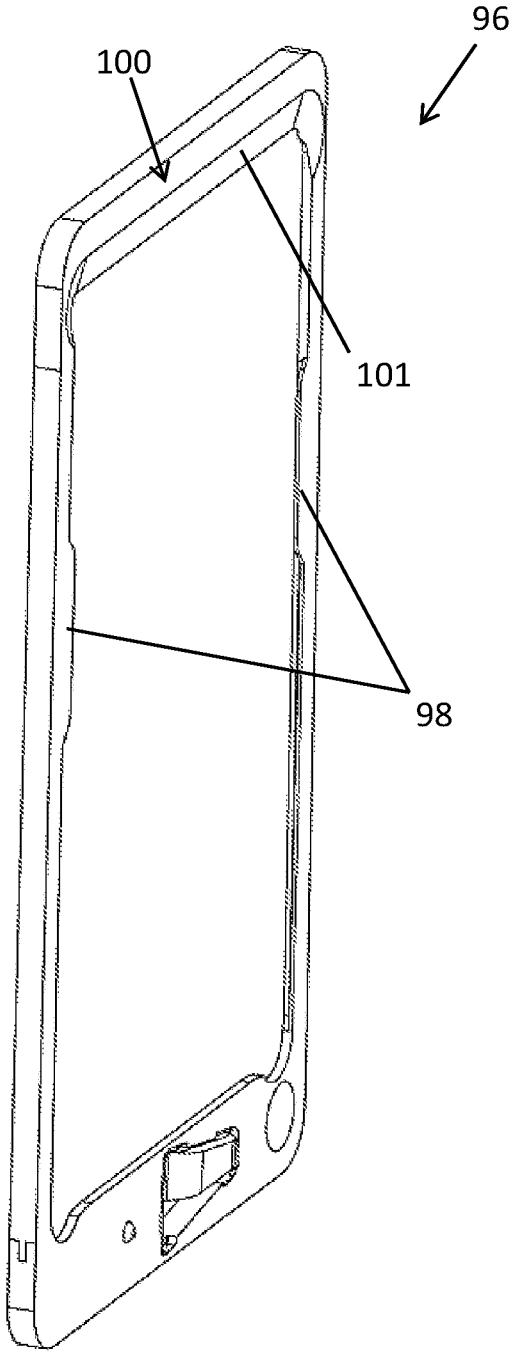
FIG. 11 is a rear perspective view of a collapsible article holder.

FIGS. 10 and 11—Another Article Holder Embodiment

In one embodiment, an article holder 96 includes all of the elements of holder 76 except article grippers 94. Holder 96 further includes front article retainers 98 and a top article retainer 100. In one embodiment, holder 96 is made of a high strength durable composite, such as carbon fiber. However, holder 96 can consist of any suitably durable material such as polycarbonate, ABS, Delrin, aluminum, stainless steel, carbon steel, titanium, and the like.

Front retainers 98 prevent an inserted article (not shown) from falling out of the front of holder 96. Top retainer 100 prevents an inserted article (not shown) from falling out of the top of holder 96 when in its closed position. Top retainer 100 includes a tapered lead out surface 101 to aid in the removal of an article when holder 96 is in it open position. In one embodiment, article holder 96 includes a top retainer 100 and front retainers 98 on the reverse side of holder 96 such that one holder 96 can provide two distinct compartments for articles.

Figure 12:
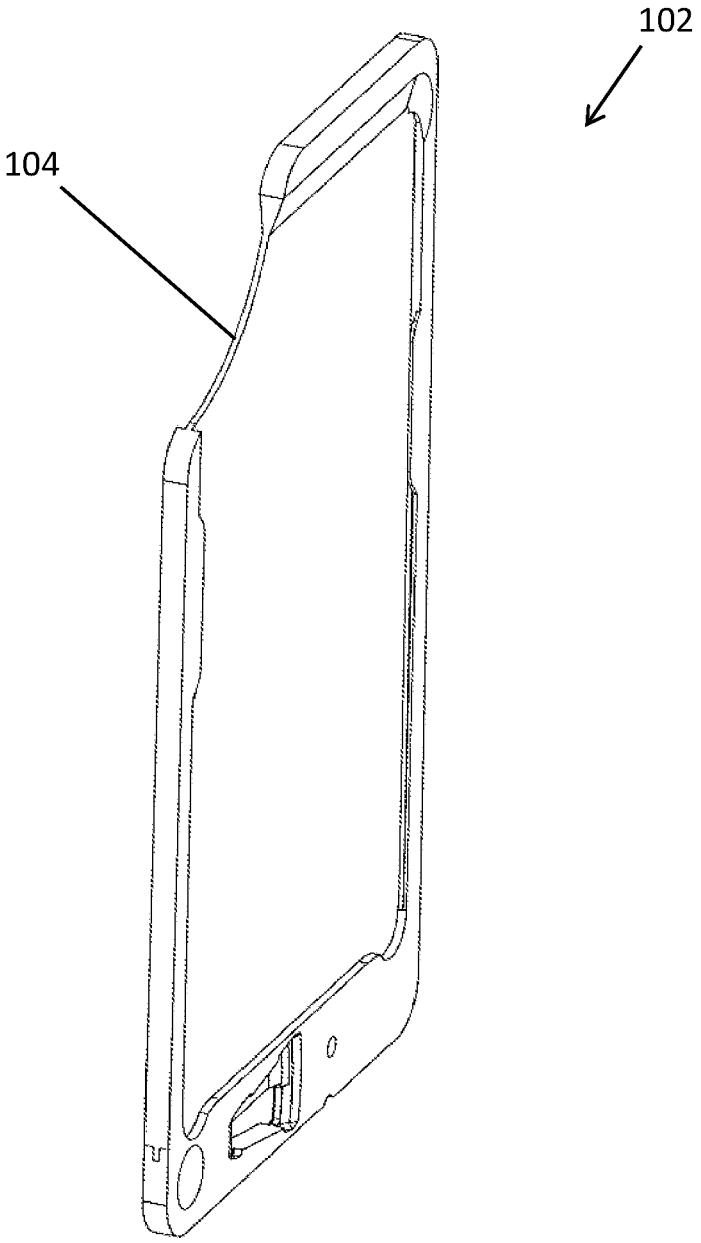
FIG. 12 is a perspective view of a collapsible article holder.

FIG. 12—Another Article Holder Embodiment

In one embodiment, an article holder 102 includes all of the elements of holder 96 and further includes a cutout 104 which aids in the insertion of an article when holders 102 are in their closed positions.

Figure 13:
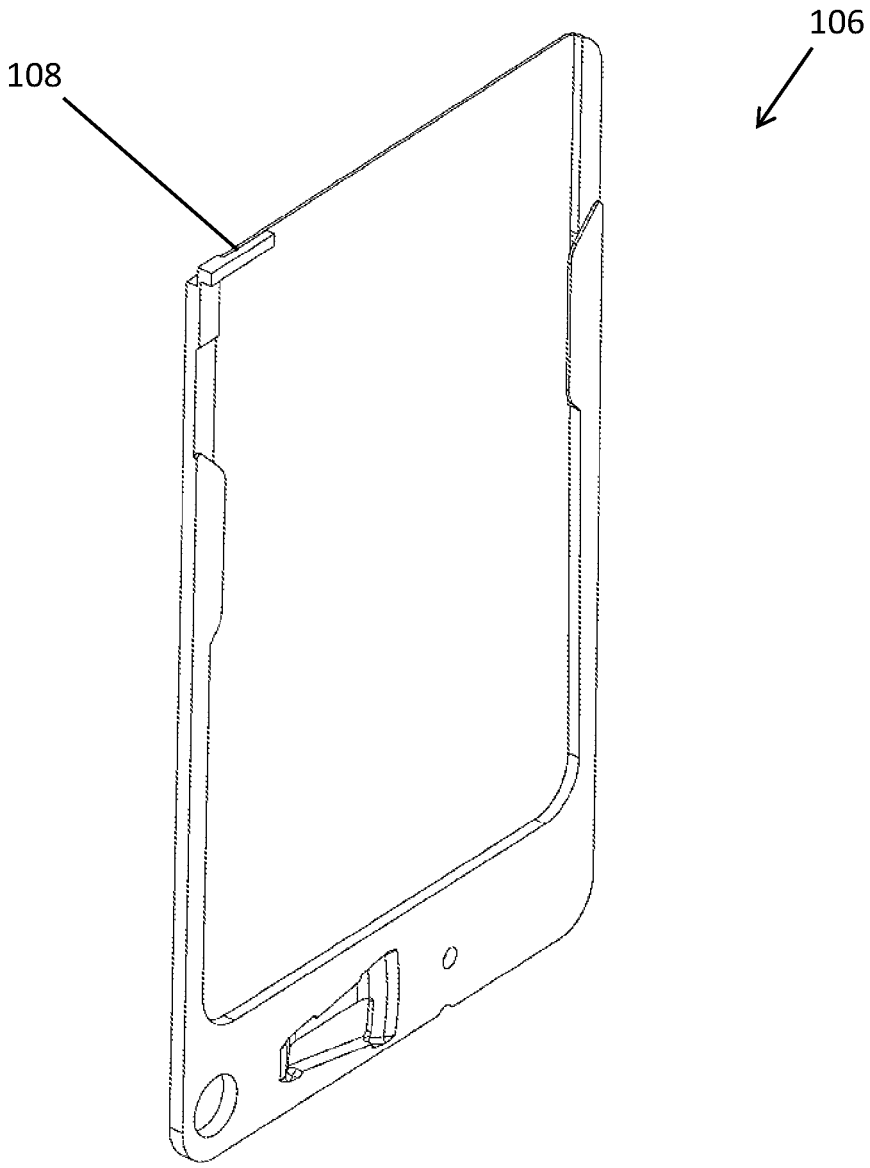
FIG. 13 is a perspective view of a collapsible article holder.

FIG. 13—Another Article Holder Embodiment

In one embodiment, an article holder 106 includes all of the elements of holder 96 except top retainer 100 and further includes article door 108. Article door 108 prevents the article in an adjacent holder from falling out when holders 106 are in their closed positions. Thus, assuming rear cover 16 or 74 has an article door 108 (not shown), all articles will only be able to be removed when holders 106 are in their open positions.

In some embodiments, rear cover 16 is replaced with a one-sided article holder. In some embodiments, rear cover 74 is replaced with a one-sided article holder.

Figure 14:
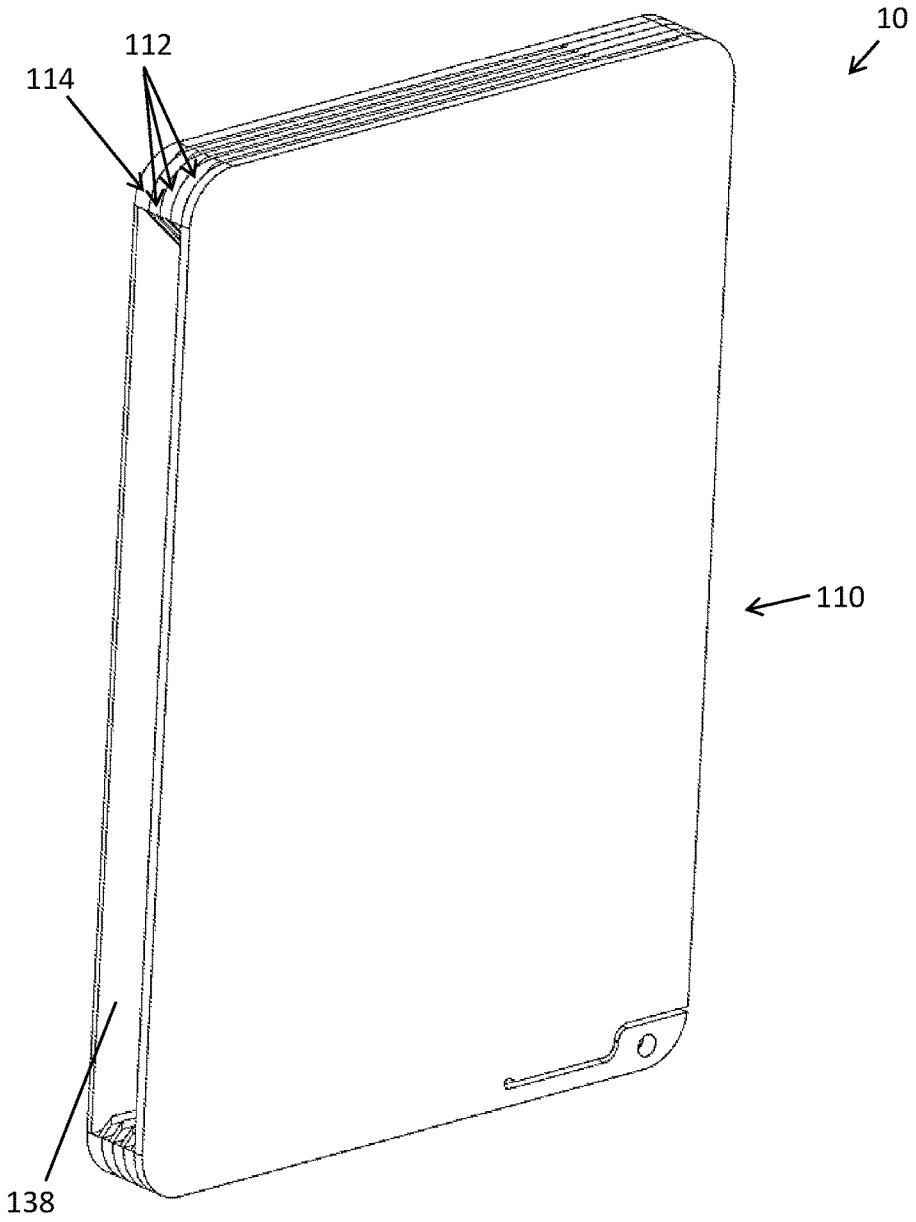
FIG. 14 is a perspective view of an article storage device in its closed configuration.
Figure 15:
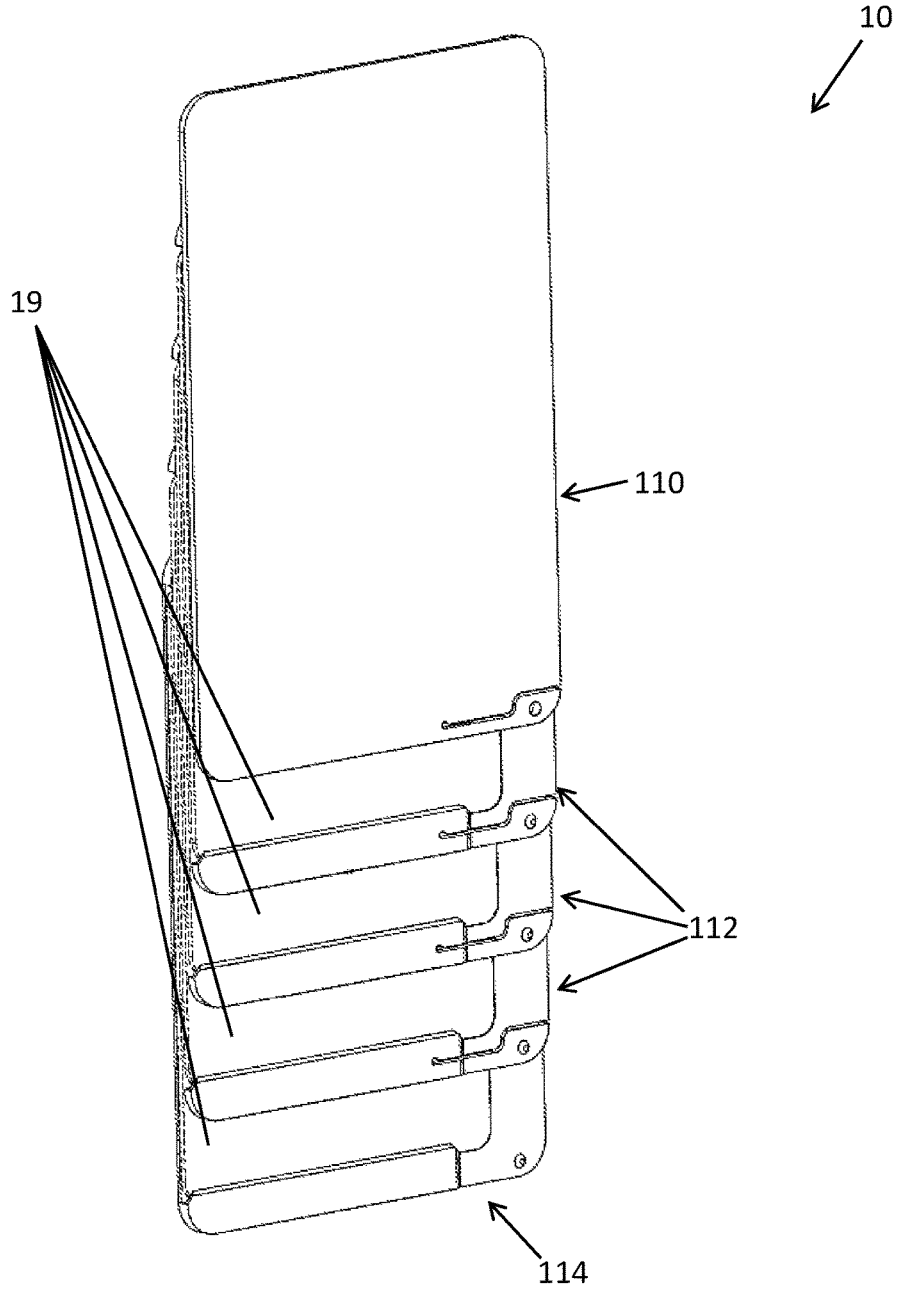
FIG. 15 is a perspective view of an article storage device containing articles with collapsible article holders in their open positions.

FIGS. 14 and 15—Another Embodiment

In one embodiment, storage device 10 includes a cover 110, a plurality of collapsible article holders 112, and an end article holder 114. End holder 114 is slidably mounted to the adjacent holder 112. Each holder 112 is slidably mounted to either (a) end holder 114 and to another holder 112, (b) two adjacent holders 112, or (c) one adjacent holder 112 and to cover 110. FIG. 15 illustrates this embodiment of device 10 with holders 112 and cover 110 in their open positions. As shown in FIGS. 14 and 15, cover 110, holders 112, and end holder 114 are able to toggle slidably from their closed positions (FIG. 14) into their open positions (FIG. 15) which allow the user to view each article 19 contained within holders 112 in order to facilitate selection and removal of one or more articles 19.

In one embodiment, storage device 10 includes one cover 110, one collapsible article holder 112, and one end article holder 114. End holder 114 is slidably mounted to holder 112 which is, in turn, slidably mounted to cover 110. In one embodiment, storage device 10 includes one cover 110, which is slidably mounted to one end article holder 114.

Figure 16:
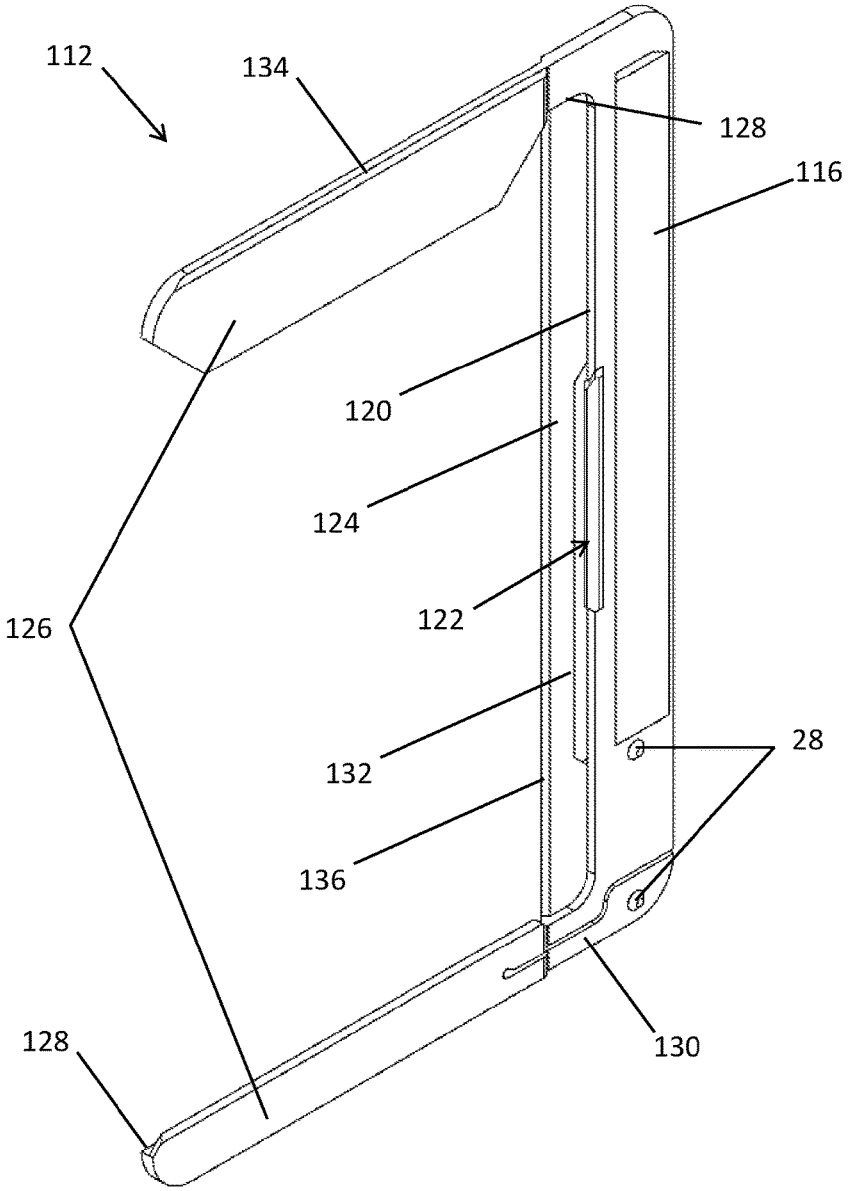
FIG. 16 is a perspective view of a collapsible article holder.
Figure 17:
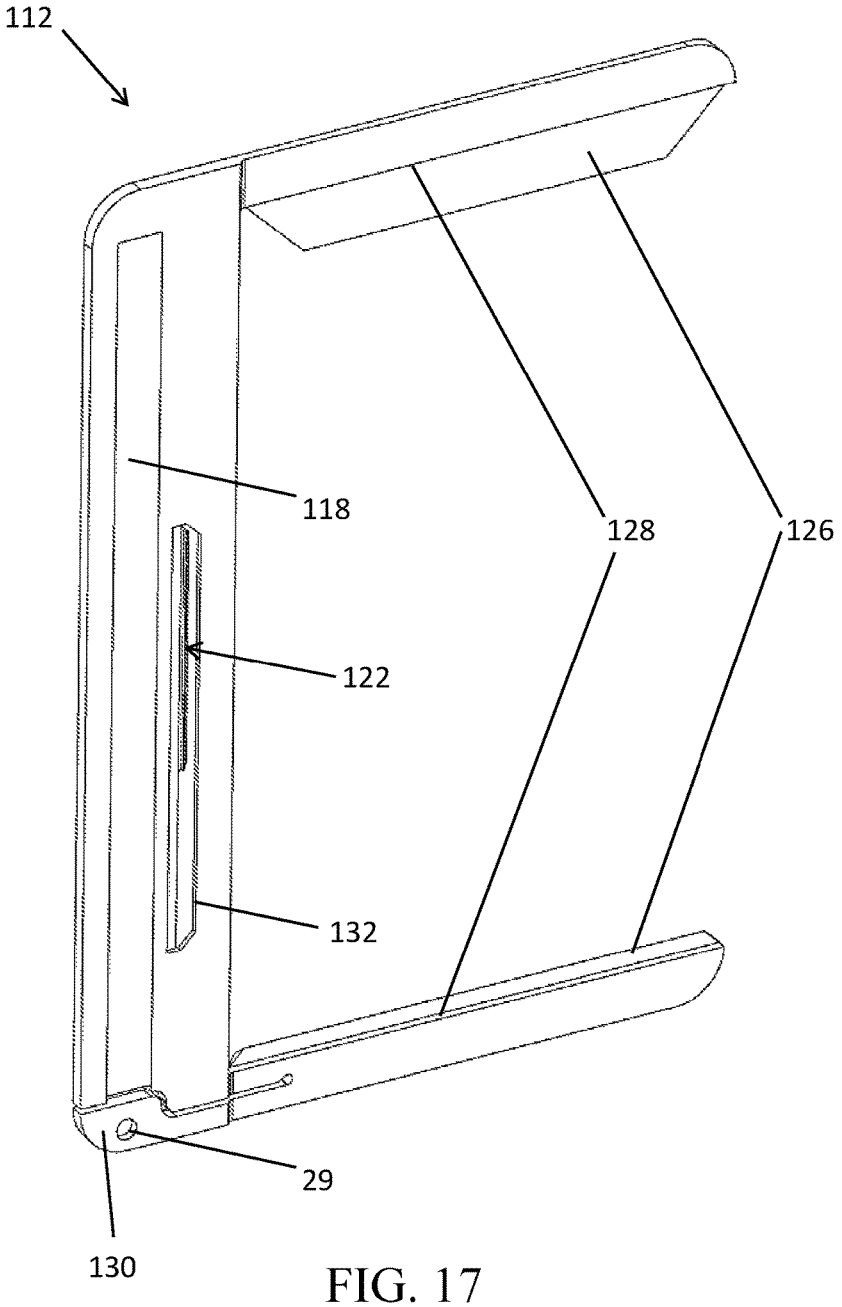
FIG. 17 is a rear perspective view of a collapsible article holder.

FIGS. 16 and 17—Another Article Holder Embodiment

In one embodiment, holder 112 includes a dovetail holder stop 116, indexing bumps 28, an indexing pocket 29, a blind dovetail cutout 118, an article stop 120, an article gripper 122, a back wall 124, front walls 126, side walls 128, and prong 130. In one embodiment, holder 112 is made of a high strength durable composite, such as carbon fiber. However, holder 112 can consist of any suitably durable material such as polycarbonate, ABS, Delrin, aluminum, stainless steel, carbon steel, titanium, and the like.

Holder stop 116 may be placed into the cutout of an adjacent holder during the assembly of storage device 10 by deflecting the prong of an adjacent holder. Similarly, the holder stop of a second adjacent holder may be placed into cutout 118 by deflecting prong 130. Holder stop 116 and cutout 118 thusly restrict the translational position of holder 112 relative to adjacent holders to a suitable range. Similar to the interaction between holder stop 116 and cutout 118 with adjacent holders, indexing bumps 28 mate with the indexing pocket of an adjacent holder and indexing pocket 29 mates with the indexing bumps of a second adjacent holder. Indexing pocket 29 and indexing bumps 28 thusly index holder 112 into either the open or closed position. Prong 130 aids the indexing process by deflecting to allow for bumps 28 reach pocket 29 without causing undue stress to holder 112.

Back wall 124, the front surface of the front wall of a rear-adjacent holder, front walls 126, and side walls 128 aid the alignment and insertion of article 19 (FIG. 15) into holder 112. Article stop 120 stops article 19 (FIG. 15) once it is in its fully inserted position. Gripper 122 contacts the surface of article 19 to prevent unwanted motion article 19. Gripper 122 includes a tapered edge 123 so that once article 19 is inserted, the deflected gripper 122 does not interfere with an adjacent holder. In one embodiment, back wall 124 includes a slot 132 so that the gripper from an adjacent holder doesn't interfere with the motion of holder 112. Front walls 126 include chamfers 134 to aid in the closing of device 10. Back wall 124 includes a chamfer 136 to aid the insertion of article 19.

In one embodiment, cover 110 includes a cutout 118 (FIG. 17), an indexing pocket 29 (FIG. 17), and a prong 130 (FIG. 17). Similar to its function in holder 112, cutout 118 restricts the translational position of cover 110 to a suitable range. Similar to its function in holder 112, indexing pocket 29 indexes cover 110 into either its open or closed position. Similar to its function in holder 112, prong 130 facilitates the insertion of an adjacent holder stop into cutout 118 and aids the indexing process by deflecting to allow for adjacent bumps to reach pocket 29 without causing undue stress to cover 110.

In one embodiment, end holder 114 includes all of the features of holder 112 except for cutout 118, back wall 124, indexing pocket 29, prong 130, and slot 132. End holder 114 further includes back wall 138 (FIG. 14), which covers the entire back of the inserted article 19 (FIG. 15) to both guide insertion as well as to protect the back of inserted article 19.

OPERATION—FIGS. 1-6

In one embodiment, illustrated in FIGS. 1-6, a user would assemble device 10 with as many holders 14 (and the corresponding number of spacers 72) as they desire, and insert their articles 19 into article grooves 34. When retrieving one or more of the articles 19, the user would rotate front cover 12 to index holders 14 into their open positions (FIG. 2). The user would then select and remove the desired article(s) 19. The user could then choose to either leave holders 14 in their open position or to rotate front cover 12 such that holders 14 index into their closed positions. To re-insert one or more of the retrieved articles 19, the user would simply locate the vacant holder(s) 14 and insert article(s) 19 into this (these) holder(s) article grooves 34.

In embodiments where rear cover 16 can store articles (FIG. 4), the user may elect to rotate door 44 a suitable amount, insert one or more articles (not shown), then rotate door 44 into its closed position. The user may then follow a similar procedure to retrieve one or more articles (not shown) from rear cover 16.

OPERATION—FIG. 7

In one embodiment, illustrated in FIG. 7, the user would operate device 10 in a similar fashion to the embodiment illustrated in FIGS. 1-6, except that rear cover 74 is unable to store articles.

OPERATION—FIGS. 8-9

In embodiments of device 10 that utilize holders 76 (FIGS. 8 and 9), the user would operate device 10 in a similar fashion to the embodiment illustrated in FIGS. 1-6, except instead of inserting articles into grooves 34, articles would instead be inserted under grippers 94.

OPERATION—FIG. 10

In one embodiment, illustrated in FIG. 10, the user would operate device 10 in a similar fashion to the embodiment illustrated in FIGS. 1-6, except (a) instead of inserting articles into grooves 34, articles would instead be inserted under retainers 98 and (b) articles 19 may only be inserted when holders 96 are in their open positions.

OPERATION—FIG. 11

In one embodiment, illustrated in FIG. 11, the user would operate device 10 in a similar fashion to the embodiment illustrated in FIG. 10, except articles could be inserted under either retainers 98 on the front side of holders 96 or under retainers 98 on the reverse side of holders 96.

OPERATION—FIG. 12

In one embodiment, illustrated in FIG. 12, the user would operate device 10 in a similar fashion to the embodiment illustrated in FIG. 11, except articles 19 may also be inserted when holders 102 are in their closed positions.

OPERATION—FIG. 13

In one embodiment, illustrated in FIG. 13, the user would operate device 10 in a similar fashion to the embodiment illustrated in FIG. 10, except top retainer 100 is replaced with article door 108.

OPERATION—FIGS. 14-17

In one embodiment, illustrated in FIGS. 14-17, a user would assemble device 10 with as many holders 112 as they desire by deflecting prongs 130 and inserting holder stops 116 into the mating cutouts 118. The user would then insert their articles 19 under front walls 126, between side walls 128, over the front surface of the front wall of a rear-adjacent holder, over back wall 124, and under gripper 122. When retrieving one or more of the articles 19, the user would slide cover 110 to index holders 112 into their open positions (FIG. 15). The user would then select and remove the desired article(s) 19. The user could then choose to either leave holders 112 in their open position or to slide front cover 110 such that holders 110 index into their closed positions. To re-insert one or more of the retrieved articles 19, the user would simply locate the vacant holder(s) 112 and insert article(s) 19 into this (these) holder(s).

While certain embodiments of the present invention have been described, it will be appreciated that changes and modifications can be made and that other embodiments may be devised without departing from the true spirit and scope of the invention.

I claim:

1. An expandable device for the storage and organization of articles, comprising:

a substantially flat front cover comprising a holder stop near its periphery and a cylinder which protrudes from its surface near its periphery;

a plurality of substantially flat article holders which are detachably and rotatably mounted near their periphery to the cylinder, each comprising a holder stop which protrudes from its surface and a cutout which mates with an adjacent holder stop to restrict the rotational motion of the holder;

a substantially flat rear cover which is detachably and rotatably mounted near its periphery to the cylinder such that the holders are disposed between the front cover and the rear cover, comprising a cutout which mates with an adjacent holder stop to restrict the rotational motion of the rear cover;

a plurality of spacers which can be added to the end of the cylinder to expand the device to organize and store more articles if desired;

a fastener which prevents substantial motion of the holders and the rear cover along the cylinder; and a compression spring whose inner diameter is slightly larger than the diameter of the cylinder that maintains a suitable tightness between the front cover, the holders, and the rear cover;

whereby the device is able to (a) fan out articles to facilitate selection, (b) receive articles into an empty holders even when adjacent holders or covers are aligned as is the case in the device's closed configuration, (c) expand or contract to remain as compact as possible when assembled with any desired number of holders.

2. An expandable device for the storage and organization of articles, comprising:

a plurality of substantially flat article holders which are slidably connected to each other, comprising:

a holder stop and a slot cutout which can mate with the cutout of a first adjacent holder and a holder stop of a second adjacent holder, respectively, and permit the first and second adjacent holders to translate along the holder's surface but substantially prevents adjacent holders from rotating or separating in a direction substantially perpendicular to the holder's surface; and a prong that normally blocks the opening at one end of the cutout which can be deflected during assembly and disassembly to allow the holder stop of an adjacent holder to be inserted into the cutout.

3. The holder of claim 2, further comprising:

a back wall which rests against a rear surface of an article;

a gripper which deflects upon article insertion and grips a front surface of the article; and an article stop which indexes the article into an inserted location.

4. The holder of claim 2, further comprising:

front walls which protrude from an area of the holder near the cutout, comprising a front surface which helps guide an article into a first adjacent holder and a rear surface which helps guide an article into the holder.

5. The device of claim 2, further comprising:

a cover which shields an article inserted into an adjacent holder, comprising:

a slot cutout which can mate with the holder stop of an adjacent holder and permit the adjacent holder to translate along the cover's surface but substantially prevent the adjacent holder from rotating or separating in a direction substantially perpendicular to the cover's surface; and a prong that normally blocks the opening at one end of the cutout which can be deflected during assembly and disassembly to allow the holder stop of the adjacent holder to be inserted into the cutout of the cover.

6. The device of claim 2, further comprising:

an end holder which shields an article inserted into an adjacent holder, comprising a holder stop which can mate with the cutout of an adjacent holder and permit the adjacent holder to translate along the end holder's surface but substantially prevents the adjacent holder from rotating or separating in a direction substantially perpendicular to the end holder's surface.

* * * * *